US006628904B2

(12) United States Patent
Yamada

(10) Patent No.: US 6,628,904 B2
(45) Date of Patent: Sep. 30, 2003

(54) IMAGE FORMING APPARATUS

(75) Inventor: Ayako Yamada, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/017,594

(22) Filed: Dec. 18, 2001

(65) Prior Publication Data

US 2003/0113125 A1 Jun. 19, 2003

(51) Int. Cl.[7] ..... G03G 15/08
(52) U.S. Cl. ..... 399/27
(58) Field of Search ..... 399/27, 30, 53, 399/58, 59, 61, 62, 81, 85

(56) References Cited

U.S. PATENT DOCUMENTS 5,237,372 A * 8/1993 Ishii et al. ..... 399/30
5,802,419 A * 9/1998 Sakurai et al. ..... 399/27 X
5,826,134 A * 10/1998 Hino et al. ..... 399/27
5,923,917 A * 7/1999 Sakurai et al. ..... 399/27

FOREIGN PATENT DOCUMENTS

JP 04-084170 * 3/1992
JP 2001-083842 3/2001

* cited by examiner

*Primary Examiner*—Sandra Brase
(74) *Attorney, Agent, or Firm*—Foley & Lardner

(57) ABSTRACT

An image forming apparatus of the present invention comprises a developing device to form a positive image by supplying toner to an image carrier, a toner residual amount detecting unit to detect residual tone amount that can be supplied from the developing device, a comparing unit to compare a set toner consumption that is consumed under set image forming conditions with the residual toner amount, an advance warning signal output unit to generate an advance warning signal for generation of the interruption during the image forming before starting the image forming under the set image forming conditions when the result of comparison by the comparing unit is (Set toner consumption)>(Residual toner amount), and a display device to display the advance warning signal for generation of the interruption, and warns user the generation of interruption of the image forming operation in advance before starting the image forming operation and urges to prepare for avoiding the interruption of the operation.

17 Claims, 4 Drawing Sheets

IMAGE FORMING APPARATUS

BACKGROUND OF THE INVENTION

1. Field of the Invention

The present invention relates to an image forming apparatus of electro-photographic system such as copying machines, printers, etc, that is capable of efficient image forming when residual amount of toner to be supplied to electrostatic latent images formed on a photosensitive drum decreased.

2. Description of the Related Art

In a developing device used in an image forming apparatus of electro-photographic system for development using a so-called two-component developer comprising toner and carrier, toner density in the developing device is detected by an automatic toner sensor and according to the detected result, additional toner is supplied from a toner cartridge for maintaining the developing density at a desired level.

So far, residual toner amount in a toner cartridge was detected and when residual toner amount decreased to a specified near empty state, the near empty was displayed. In the case where a large volume of copying or printing was required, user once interrupts the image forming operation when recognized this near empty display, exchanged a toner cartridge. On the other hand, in the case of copying or printing of small volume, the image forming operation was continued and a toner cartridge was exchanged at the time when the toner empty was displayed.

Such the residual toner displayed device is similarly used in a cartridge type developing device using one-component toner. For example, an image forming apparatus that displays the number of residual formable sheets for the future by calculating the number of image sheets that are formable from residual tone amount for the future by detecting residual amount of one-component toner in a developing cartridge using an electrostatic capacity detecting system was disclosed in Japanese Patent Application No. 2001-83842. When the number of formable sheets is displayed, user exchanges a developing cartridge or supplies additional toner to the developing device according to the displayed device contents.

However, by such the conventional technology it is difficult to grasp whether a desired image forming operation can be made within residual toner amount, that is, within the number of formable image forming sheets before starting the image forming operation. In particular, when a desired image forming is for a large volume of original documents or it is desired to obtain a large amount of copies in the 2-in-1 mode or the 4-in-1 mode, even if the number of image formable sheets is simply displayed, user must compute and judge whether the desired image forming can be made within the displayed formable sheets.

Further, although the near toner empty is not displayed at the beginning when the image forming operation is started, the near toner empty may be displayed during the operation. In particular, if a desired image forming was voluminous, the near toner empty might be displayed during the operation in many cases and it was forced to interrupt the image forming operation. Further, when the operation was restarted, it became necessary to check the number of image formed copies already completed and reset the image forming conditions for remaining copies and thus, the operability of a copying machine could be lowered. Particularly, when the image forming operation is directed through a personal computer (PC) terminal such as a printer or when user was left from a copying machine in copying a large amount of sheets, user was not aware of the interruption of the image forming operation and a copying machine was left in the interrupted state and its productive could be lowered.

Accordingly, it is possible for user to easily recognize whether a desired image forming operation that is going to start is within residual toner amount before starting the image forming operation. When toner becomes empty during the operation, it is desired to urge user to take action for avoiding the interruption before starting the image forming operation and avoid the interruption of the operation, thereby improving operability and productivity.

SUMMARY OF THE INVENTION

An object of the present invention is to provide an image forming apparatus that has high operability as well as productivity by urging user to take action to avoid the image forming operation from being interrupted during the operation for empty of toner prior to starting the image forming operation.

According to the embodiment of the present invention, an image forming apparatus is provided. This image forming apparatus comprises: a developing device to form a positive image by supplying toner to an image carrier; a residual toner amount detecting unit to detect residual toner amount that can be supplied from the developing device; a comparing unit to compare a set toner consumption that is consumed under set image forming conditions with the residual toner amount; an advance warning signal output unit to generate an advance warning signal for generation of interruption during the image forming before starting the image forming under the set image forming conditions when the result of comparison by the comparing unit is (Set toner consumption)>(Residual toner amount); and a display device for displaying the advance warning signal for generation of interruption.

Further, according to the embodiment of the present invention, an image forming apparatus is provided. This image forming apparatus comprises: a developing device to form a developed image by supplying toner to an image carrier; a residual toner detecting unit to detect residual toner amount retained in the developing device; a comparing unit to comparing a set toner consumption that is consumed under set image forming conditions with the residual toner amount; a substitute condition changing unit to changing substitute image forming conditions to those that are approximate to the set image forming conditions when the result of comparison by the comparing unit is (Set toner consumption)>(Residual toner amount), that is, when the expected toner consumption is within the residual toner amount; and a display device to display the substitute image forming conditions.

Further, according to the embodiment of the present invention, an image forming apparatus is provided. This image forming apparatus comprises: a toner cartridge containing toner; a developing device to forming a developed image by supplying the toner supplied from the toner cartridge to an image carrier; a residual toner amount detecting unit to detect residual toner amount in the toner cartridge; a comparing unit to compare set toner consumption that is consumed under the set image forming conditions with the residual toner amount; a substitute condition changing unit for changing the substitute image forming condition to substitute image forming conditions approximate to the set image forming conditions when the result of comparison by the comparing unit is (Set toner consumption)>(Residual toner amount), that is, when the expected toner consumption is within the residual toner amount, and a display device to displaying the substitute image forming conditions.

DETAILED DESCRIPTION OF THE INVENTION

Figure 1:
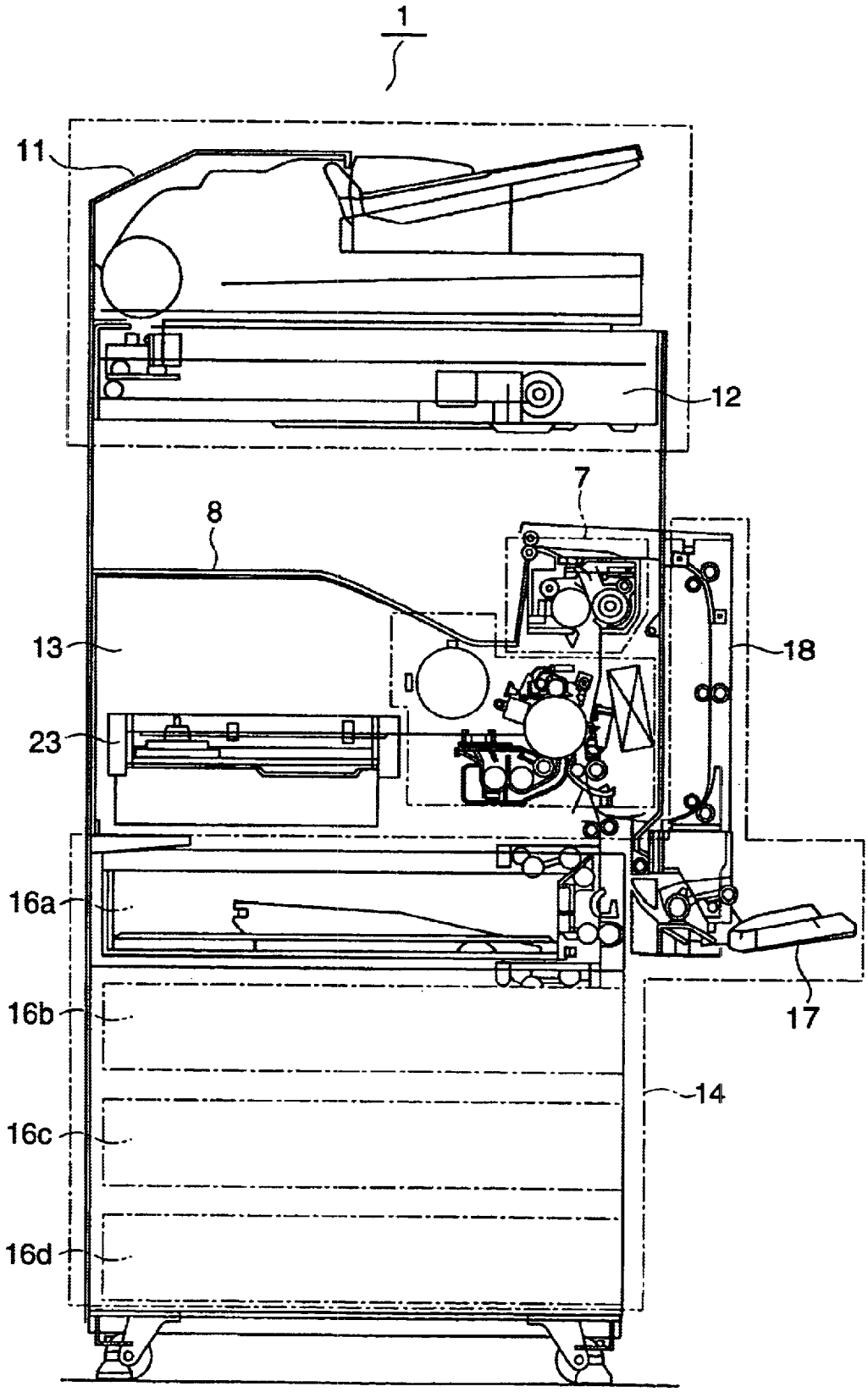
FIG. 1 is a schematic diagram showing an image forming system in an embodiment of the present invention.

A preferred embodiment of the present invention will be described below in detail referring to attached drawings. FIG. 1 is a schematic block diagram showing an image forming system 1 using a printer 10 as an image forming apparatus. On the top of the printer 10, an automatic document feeder 11 (hereinafter, abbreviated to ADF) and an mage reading scanner 12 are provided. Further, in the main body of the printer 10, a paper supply portion 15 including an image forming unit 13, first through fourth paper cassettes 16*a*~16*d*, a manual paper supply tray 17 and a duplex unit 18, a fixing device 7 and a paper discharge device 8 are provided. This printer 10 is capable of forming images in a single mode, duplex mode, 2-in-1 mode, and 4-in-1 mode.

Figure 2:
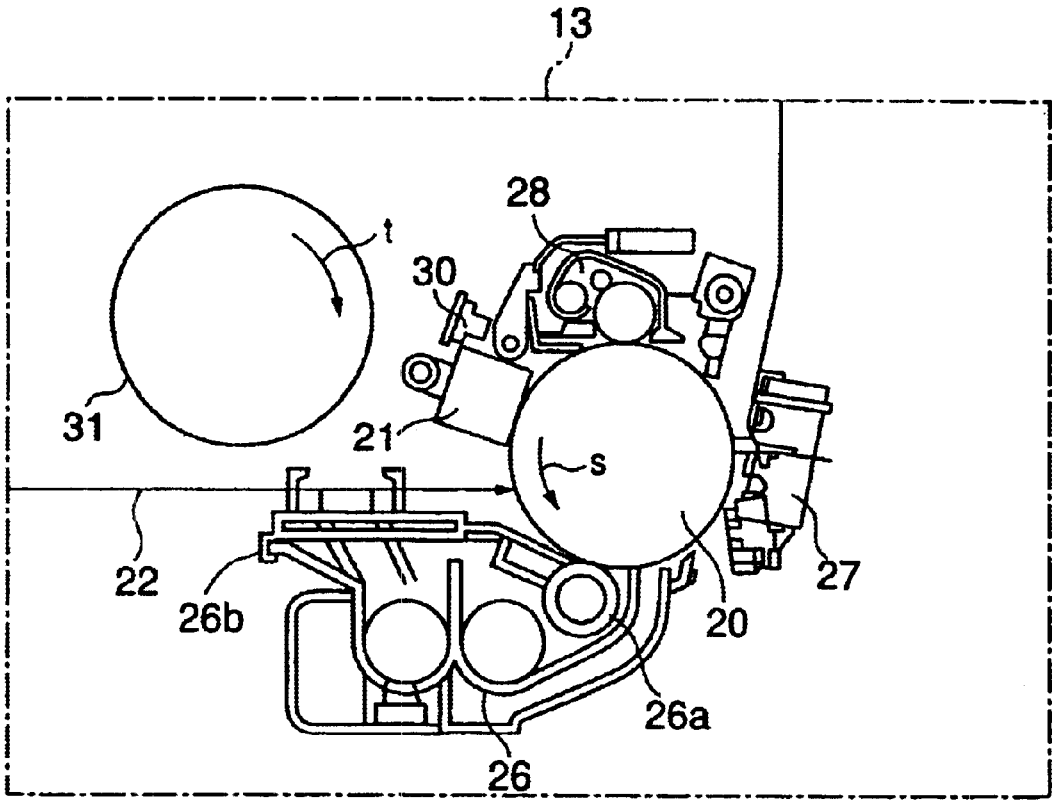
FIG. 2 is a schematic diagram showing an image forming unit in an embodiment of the present invention.

As shown in FIG. 2, the image forming unit 13 has a charger 21, an exposure unit 24 to which laser beam 22 is applied from a laser unit 23 according to image data read by the image reading scanner 12 or image data from PC or facsimile, a developing device 26 that accommodates two-component toner comprising toner and carrier and supplies the two-component toner to a photosensitive drum 20 by a developing roller 26*a*, a transfer/separation charger 27, a cleaner 28 and a charge eliminating lamp 30 around the photosensitive drum 20 that is an image carrier in its rotating direction. Further, 31 is a toner cartridge for supplying toner to the developing device 26. Toner is supplied from the toner cartridge 31 to the developing device 26 to a rate of toner at about 5% against carrier at about 95%. The rate of toner in the developing device 26 is constantly supervised by a magnetic sensor (not shown), etc.

The printer 10 that has such the image forming unit 13 is uniformly charged by the main charger 21 according to the rotation of the photosensitive drum 20 in the arrow direction "s". Then, the laser beam 22 is applied to the drum 20 from the laser unit 23 corresponding to image data and a latent image corresponding to the image data is formed on the photosensitive drum 20. Further, toner is supplied to this latent image from the developing device 26 and a toner image that is a positive image is formed on the photosensitive drum 20.

On the other hand, a sheet of paper that is a transfer material (not shown) taken out of a paper supply unit 14 synchronous with the formation of a toner image, is conveyed to the position of the transfer/separation charger 27 and the toner image formed on the photosensitive drum 20 is transferred on the transfer material by the transfer/separation charger 27 and thereafter, fixed in a fixing device 7 and discharged to the discharge device 8. The image forming on a transfer material is thus completed.

Figure 3:
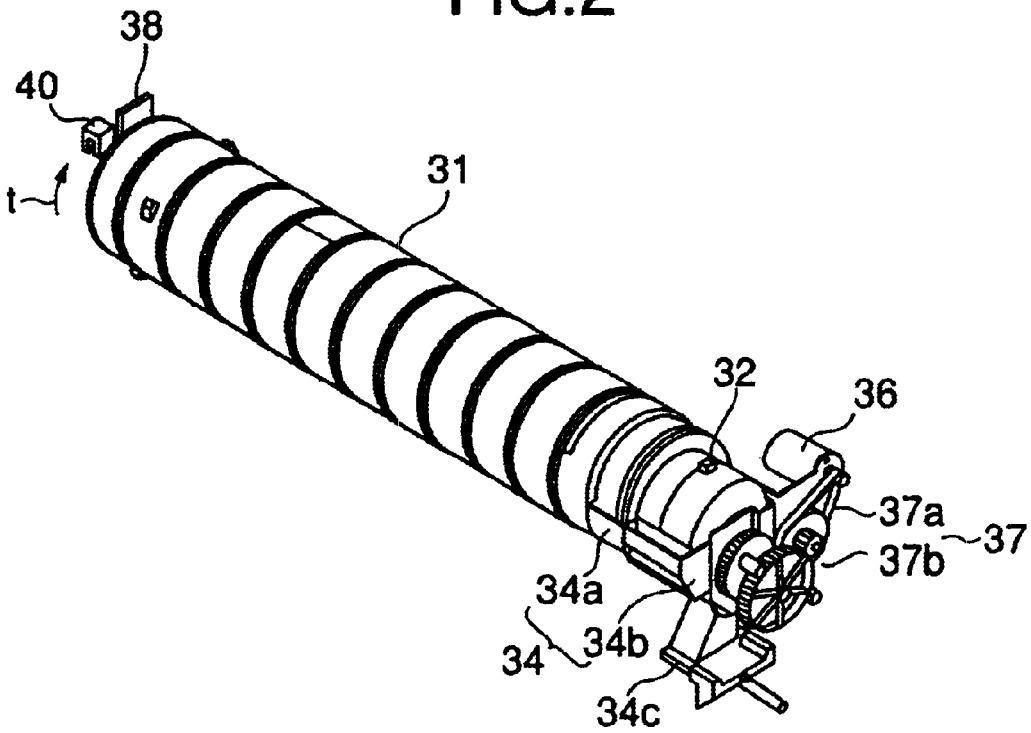
FIG. 3 is a schematic perspective view showing a toner cartridge and a rotary driving device in an embodiment of the present invention.

Next, the toner cartridge 31 will be described in detail. The toner cartridge 31 is in a nearly cylindrical shape and a spiral convex portion (not shown) is formed on the inner surface. On the surface of the tip of the toner cartridge 31, a toner supply port 32 is formed. The toner cartridge 31 moves toner in the inside to the toner support port 32 by rotating in the arrow direction "A" as shown in FIG. 2 and FIG. 3, discharges a specified amount of toner from the toner supply port 32 and supplies to a supply port 26*b* of the developing device 26.

When installing in the printer 10, the toner cartridge 31 is compressed in a holder 34*a* of a toner supply portion 34 at the printer 10 side and is connected to a driving motor 36 that is mounted to a support plate 34*c* and a rotary driving device 37 including a belt driving mechanism 37*a* for deceleration and a gear driving mechanism 37*b*, and is driven by the rotary driving device 37 in the arrow direction "A". Further, the toner supply portion 34 has a guide plate to lead toner to the supply port 26*b* of the developing device 26.

On the surface of the rear edge of the toner cartridge 31, a flanged switch 38 is formed. Near the rear end of the toner cartridge 31, there is provided a photo-sensor 40 that is a residual amount detector for detecting residual amount of toner in the toner cartridge 31 and the number of revolutions of the toner cartridge 31 is detected by the passing of the flanged switch 38. That is, as the toner cartridge 31 supplies a specified amount of toner to the developing device 26 through the toner supply port 32 whenever the toner cartridge rotates by one turn in the arrow direction "t", a printer CPU 51 that will be described later computes toner consumption and the residual mount of toner in the toner cartridge 31 is computed by subtracting the toner consumption from the capacity of the toner cartridge 31.

Figure 4:
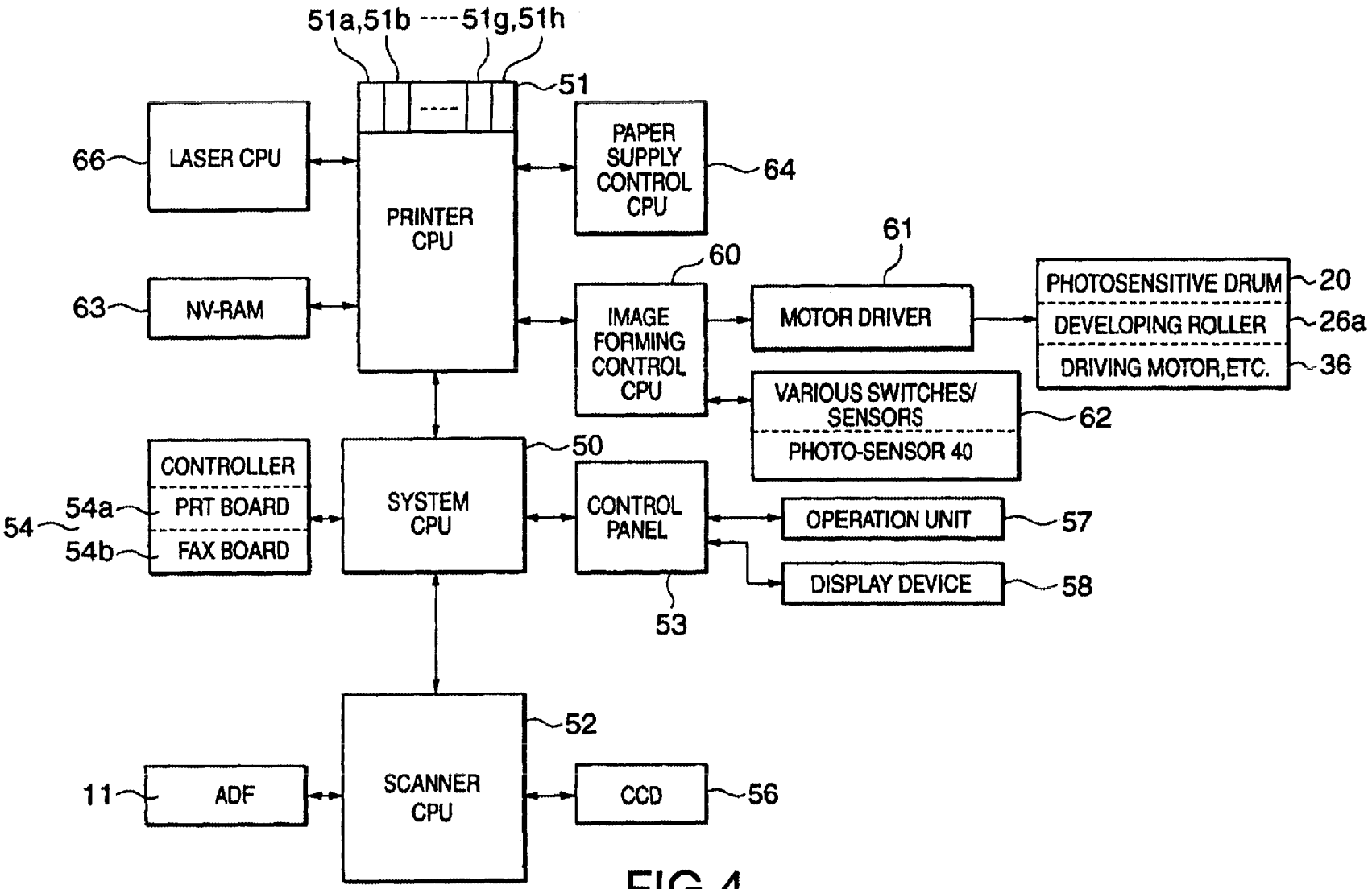
FIG. 4 is a block diagram showing the control system of the image forming system in the embodiment of the present invention.

Next, FIG. 4 shows the structure of the control system of the image forming system 1. A CPU 50 that controls the entirety of the image forming system 1 is connected with the printer CPU 51 for controlling the printer 10, a scanner CPU 52 for controlling the scanner 12, and a controller 54 that has a PRT board 54*a* and a FAX board 54*b* that are connected to a printer and a facsimile that are external terminals of a control panel 53. The scanner CPU 52 is connected to a Charge Coupling Device 56 (hereinafter, abbreviated to CCD) of the scanner 12 and the ADF 11 for controlling them. The control panel 53 is provided with a control portion 57 comprising a ten-key, a print key, etc. and a displayed device 58.

To the printer CPU 51, motor drivers 61 for driving a motor 36 for driving the photosensitive drum 20, the developing roller 26*a* and the toner cartridge 31 through the image forming control CPU 60 that controls the image forming unit 13, and switches/sensors 62 for detecting various operation timings including the photo-sensor 40 for detecting the rotation of the toner cartridge 31 are connected. Further, a non-volatile memory 63 (hereinafter, abbreviated to NV-RAM) for storing the number of revolutions of the toner cartridge 31 and computed results of the printer CPU 51 is connected to the printer CPU 51. Further, a paper supply control CPU 64 for controlling the paper supply portion 14 and a laser CPU 66 for controlling the laser unit 23 are connected to the printer CPU 51. This printer CPU 51 has a set toner consumption computing unit 51*a*, a comparing unit 51*b*, an advance warning signal output unit 51*c*, a substitute condition changing unit 51*d*, a number of formable sheets changing unit 51*f*, a number of set sheets computing unit 51*g* and further, a ROM 51*h* for storing mean toner consumption for each print size.

Next, the operations will be described. First, when toner becomes empty and it becomes necessary to change the toner cartridge 31 in the printer 10, the number of revolutions of the toner cartridge 31 stored in the NV-RAM 63 is cleared to zero (0) when the toner cartridge 31 is exchanged with a new cartridge. Thereafter, while the printer is operated, the toner cartridge 31 is rotated so as to maintain toner density in the developing device 26 at about 5% against carrier of about 95% and toner is supplied to the developing device. The number of revolutions of the toner cartridge 31 is detected by the photo-sensor and stored in the NV-RAM 63.

To operate the printer, various kinds of print conditions are first set by user through the operation unit 57 of the control panel 53. For example, the normal single mode or duplex mode, 2-in-1 mode or 4-in-1 mode is selected for the image forming mode, a print size is selected, and after setting the number of prints and an image forming magnification, the print condition setting is decided by turning the print key (not shown) ON.

To make the judgment as to whether the print operation under this decided print conditions is interrupted for the reason of toner empty can be known when the (Residual toner amount) of the toner cartridge 31 is compared with the set toner consumption under the set print conditions. However, the (Residual toner amount) can be converted into the number of printable sheets that is the number of image formable sheets and therefore, in this embodiment, (Number of printable sheets) is converted from (Residual toner amount) at a formable sheet changing unit 51*f* of the printer CPU 51 and further, (Number of set print sheets) that is the number of set image printable sheets is computed from the set print conditions at the set number of sheet computing unit 51*g*, and whether the print operation is interrupted is checked by comparing (Number of set print sheets) with (Number of printable sheets).

That is, as (Toner capacity) of the toner cartridge 31 is fixed and the toner amount supplied to the developing device 26 through the toner supply port 32 at one turn of the toner cartridge is constant, if the number of revolutions $\alpha$ of the toner cartridge 31 up to the present detected by the photo-sensor 40 is known, the (Toner supply amount up to the present) is computed according to the following formula:

(Supplied toner amount/one turn)$\times\alpha$=(Toner supplied amount up to the present). Accordingly, (Residual toner amount) is computed from the following formula:

(Toner capacity)−(Supplied toner amount up to the present)=(Residual toner amount).

Further, using (Mean toner consumption for every print size) stored in the ROM 51*h*, (Residual toner amount)/(Specified print size mean toner consumption)=(Number of printable sheets) is computed by the number of formable sheets changing unit 51*f* of the printer CPU 51 and by computing (Number of original documents)×(Number of print sheets)=(Number of set print sheets), (Number of set print sheets) is compared with (Number of printable sheets) by the comparing unit 51*b* of the printer CPU 51.

As a result, when (Number of set print sheets)<(Number of printable sheets), the print operation of the printer 10 is immediately started according to the set print conditions.

On the other hand, when (Number of set print sheets)>(Number of printable sheets), an advance warning signal indicating that the print interruption is generated for toner empty is output to and displayed on the displayed device 58 of the control panel 53 from the advance warning signal output unit 51*c*. Further, at the same time, when (Number of set print sheets)>(Number of printable sheets), the substitute condition changing unit 51*d* of the printer CPU 51 converts the print conditions set by user into plural patterns of substitute print conditions that are substitute image forming conditions approximate to the user set conditions within (Residual toner amount) of the toner cartridge 31 and displayed devices on the displayed device 58 of the control panel 53.

The contents of the plural patterns of substitute print conditions are such that (1) the number of print sheets is reduced, (2) the image forming magnification is lowered, (3) the image density is made thin or (4) the image forming mode is changed from the normal single mode to 1 in 1 more or 4-in-1 mode.

As a result, after confirming the warning for generation of interruption and substitute print conditions displayed on the display device 58 before starting the print operation, it becomes possible for user to select plural patterns of the print operation, for example, to perform the print operation under desired print conditions after exchanging a toner cartridge with new one when necessary or to perform the print operation after resetting the displayed substitute print conditions as new print conditions or to perform the print operation under the set print conditions until the toner empty becomes definite by turning on the print key (not shown) on the operation unit 57 again disregarding the display on the display device 58.

Figure 5:
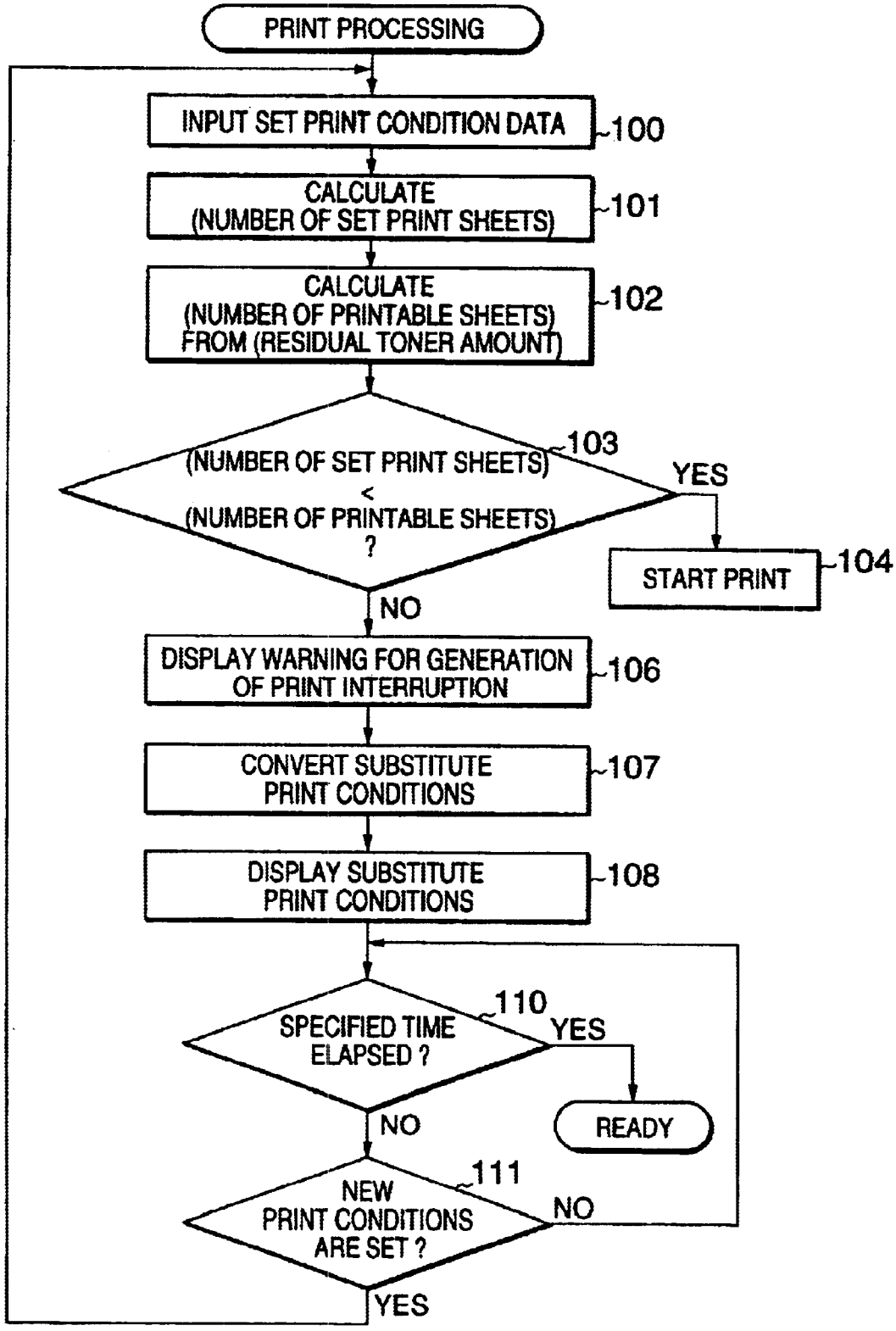
FIG. 5 is a flowchart for showing an advance warning of interruption and substitute print conditions in the embodiment of the present invention.

Next, the above operation will be described referring to the flowchart shown in FIG. 5. In Step 100, when print conditions are set from the operation unit 57 of the control panel 53 when starting the print operation, the data of set print conditions are input to the printer CPU 51 from the system CPU 50. Then, in Step 101, (Number of set print sheets) is computed using the number of set sheet computing unit 51*g* of the printer CPU 51 and in Step 102, (Number of printable sheets) is computed from (Residual toner amount) using the number of printable sheets changing unit 51*f* of the printer CPU 51.

In Step 103, (Number of set print sheets) and (Number of printable sheets) are compared by using the comparing unit 51*b* of the printer CPU 51. When (Number of set print sheets)<(Number of printable sheets), the operation goes to Step 104 and the print operation is started under the print conditions set by user. When (Number of print sheets)>(Number of printable sheets) in Step 103, the operation goes to Step 106 and an advance warning signal for the generation of print interruption is output to the system CPU 50 from the advance warning signal output unit 51*c* of the printer CPU 51 and the print interruption generating warning is displayed on the displayed device 58 of the control panel 53.

Then, going to Step 107, the substitute print conditions are converted into plural patterns using the substitute condition changing unit 51*d* of the printer CPU 51, the substitute print conditions are input to the system CPU 50 from the printer CPU 51 and the substitute print conditions are displayed on the displayed device 58 of the control panel 53.

Hereafter, when a specified time elapsed in Step 110, the system judges that user suspends the print operation and returns to the ready state. When the specified time is not elapsed in Step 110, waiting that new print conditions are set by user in Step 111, returns to Step 100.

That is, when the interruption generating warning and the substitute print conditions are displayed on the display device 58 in Step 106 or Step 108, user selects and executes an action that is most required from the suspension of printing, the printing under the substitute print conditions or the printing under the set print conditions.

When the system is constructed as described above, if it was revealed that the residual toner amount in the toner cartridge 31 is detected less and the print operation is forced to be interrupted for toner empty during the printing under the print conditions set by user, before starting the print operation, the advance warning for generation of interruption is displayed on the display device 58 and further, substitute print conditions are displayed. Accordingly, user is able to easily recognize the generation of the interruption before starting the print operation, and taking an action to avoid generation of the interruption according to the desired print contents and improve the operability by avoiding the interruption of the print operation. Furthermore, as substitute print conditions are displayed, a method for action to avoid the print interruption can be easily grasped, the method for action can be easily set, and the operability of the printing is further improved. Furthermore, as the generation of the print interruption is warned in advance, it is avoided that user lefts the printer in the interrupted state for a long period without aware of the interruption of the print operation when left from the printer 10 as before and the productivity of the printer can be improved.

The present invention is not limited to the embodiment described above but can be varied without departing from the spirit and scope thereof and for, example, an image forming apparatus may be a copying machine or can be optionally a composite machine that has functions of copying machine, printer, facsimile, etc. Further, a developing device also can be of cartridge type using one component toner. In addition, residual toner amount can be detected optionally by detecting an electrostatic capacity in a toner cartridge or a developing cartridge. Further, when the generation of the interruption of the image forming operation is revealed, it may be displayed to user only by the voice for the advance notice of the generation of interruption or the lighting of a luminous device.

Further, number of patterns or contents of substitute image forming conditions are also not limited and when, for example, a finisher equipped with the folding and binding function is used, substitute image forming conditions can be displayed, for example, by changing the normal single mode to the folding and binding mode, and substitute image forming conditions may be mixed as described in the embodiment. Further, to check whether the set image forming operation is forced to be interrupted, a set toner consumption may be compared with a residual toner amount by computing the set toner consumption from the set image forming conditions.

According to the present invention as described above in detail, when the image forming operation under set image forming conditions is interrupted for empty of toner as the detected residual toner amount is small, an advance warning for generation of the interruption is displayed to user before starting the image forming operation. Accordingly, it is possible to take an action to avoid the interruption before starting the image forming operation and the improved operability of the system is obtained by avoiding the interruption of the operation. Further, the operation is no longer left in the interrupted state as user is not aware of the interruption of the image forming operation and it is possible to improve productivity of the image forming apparatus.

What is claimed is:

1. An image forming apparatus comprising:

a developing device to form a developed image by supplying toner to an image carrier;

a residual toner amount detecting unit to detect residual toner amount retained in the developing device;

a comparing unit to compare set toner consumption that is consumed under set image forming conditions with the residual toner amount;

a substitute condition converting unit to change substitute image forming conditions that are approximate to the set image forming conditions when toner consumption is within the residual toner amount and the result of comparison by the comparing unit is (Set toner consumption)>(Residual toner amount); and a display device to display the substitute image forming conditions.

2. An image forming apparatus according to claim 1 further comprising:

a number of image formable sheet converting unit to convert the residual toner amount into the number of image formable sheets; and a number of set sheet computing unit to compute the number of set image formable sheets from the set image forming conditions;

wherein the comparing unit compares the number of set image formable sheets converted from the set toner consumption with the number of image forming sheets converted from the residual toner amount; and wherein the substitute image forming conditions calculating unit changes the substitute image forming conditions when the result of comparison by the comparing unit is (Number of set image formable sheets)>(Number of image formable sheets).

3. An image forming apparatus according to claim 1 further comprising:

an advance warning signal output unit to generate a warning signal for generation of interruption during the image forming before starting the image forming under the set image forming conditions when the result of comparison by the comparing unit is (Set toner consumption)>(Residual toner amount).

4. An image forming apparatus according to claim 1, wherein the substitute condition changing unit changes substitute image forming conditions of plural patterns and the display device displays the substitute image forming conditions of plural patterns.

5. An image forming apparatus according to claim 1, wherein the substitute image forming conditions are the image forming conditions with the number of image formable sheets under the set image forming conditions decreased.

6. An image forming apparatus according to claim 1, wherein the substitute image forming conditions are the image forming conditions with the image magnification of the set image forming conditions decreased.

7. An image forming apparatus according to claim 1, wherein the substitute image forming conditions are the image forming conditions with the image density of the set image forming conditions decreased.

8. An image forming apparatus according to claim 1, wherein the substitute image forming conditions are the image forming conditions with the image forming modes of the set image forming conditions changed.

9. An image forming apparatus comprising:

a toner cartridge containing toner;

a developing device to form a developed image by supplying the toner supplied from the toner cartridge to an image carrier;

a residual toner detecting unit to detect residual amount of toner in the toner cartridge;

a comparing unit to compare a set toner consumption that is consumed under the set image forming conditions with the residual toner amount;

a substitute condition calculating unit to calculate substitute image forming conditions wherein a toner consumption is within the residual toner amount and is approximate to the set image forming conditions when the result of comparison by the comparing unit is (Set toner consumption)>(Residual toner amount); and a display device to display the substitute image forming conditions.

10. An image forming apparatus according to claim 9, further comprising:

a number of image formable sheet converting unit to convert the residual toner amount into the number of image formable sheets; and a number of set sheet computing unit to compute the number of set image formable sheets from the set image forming conditions;

wherein the comparing unit compares the number of set image formable sheets converted from the set toner consumption with the number of image forming sheets converted from the residual toner amount; and wherein the substitute image forming conditions calculating unit changes the substitute image forming conditions when the result of comparison by the comparing unit is (Number of set image formable sheets)>(Number of image formable sheets).

11. An image forming apparatus according to claim 9 further comprising:

an advance warning signal output unit to generate a warning signal for generation of interruption during the image forming before starting the image forming under the set image forming conditions when the result of comparison by the comparing unit is (Set toner consumption)>(Residual toner amount).

12. An image forming apparatus according to claim 9 further comprising;

a toner supply motor to drive an operation unit for supplying toner to the developing device from the toner cartridge;

wherein the residual toner amount detecting unit detects residual toner amount in the toner cartridge from the number of revolutions of the toner supplying motor.

13. An image forming apparatus according to claim 9, wherein the substitute image forming condition conversion unit changes substitute image forming conditions of plural patterns and the display device displays the substitute image forming conditions of plural patterns.

14. An image forming apparatus according to claim 9, wherein the substitute image forming conditions are the image forming conditions with the number of image forming sheets under the set image forming conditions reduced.

15. An image forming apparatus according to claim 9, wherein the substitute image forming conditions are the image forming conditions with the image magnification of the set image forming conditions decreased.

16. An image forming apparatus according to claim 9, wherein the substitute image forming conditions are the image forming conditions with the image density of the set image forming conditions lowered.

17. An image forming apparatus according to claim 9, wherein the substitute image forming conditions are the image forming conditions with the image forming mode of the set image forming conditions changed.

* * * * *